US005894976A

United States Patent [19]

Harper

[11] Patent Number: 5,894,976

[45] Date of Patent: Apr. 20, 1999

[54] ARTICLE CARRIER

[76] Inventor: W. David Harper, 102 Harper Valley Dr., Belton, S.C. 29627

[21] Appl. No.: 08/967,764

[22] Filed: Nov. 10, 1997

[51] Int. Cl.[6] ..... F41C 33/02; A45F 3/00

[52] U.S. Cl. ..... 224/587; 224/198; 224/243; 224/660; 224/625; 224/662; 224/684; 224/901.4; 224/901.6; 224/901.8; 224/911

[58] Field of Search ..... 224/587, 578, 224/579, 600, 614, 620, 625, 626, 627, 223, 660, 662, 663, 664, 676, 681, 682, 684, 235, 236, 238, 262, 907, 911, 931, 264, 904, 901.8

[56] References Cited

U.S. PATENT DOCUMENTS

| | | | |
|---|---|---|---|
| 756,177 | 3/1904 | Mills | 224/660 |
| 854,017 | 5/1907 | Batchelder | 224/931 |
| 1,418,371 | 6/1922 | Foster . | |
| 1,558,228 | 10/1925 | Botkin . | |
| 2,351,158 | 6/1944 | Stelzer . | |
| 3,664,560 | 5/1972 | Perkins . | |
| 4,029,242 | 6/1977 | Stoesser . | |
| 4,341,331 | 7/1982 | McDougall | 224/219 |
| 4,440,525 | 4/1984 | Perla | 405/186 |
| 4,579,265 | 4/1986 | Schiller . | |
| 4,613,068 | 9/1986 | Bianchi | 224/660 |
| 4,858,801 | 8/1989 | Sameniego | 224/264 |
| 4,966,320 | 10/1990 | Desantis et al. . | |
| 5,054,671 | 10/1991 | Else | 224/192 |
| 5,119,910 | 6/1992 | Heggeland | 224/620 |
| 5,240,156 | 8/1993 | Sicotte et al. | 224/901.8 X |
| 5,505,356 | 4/1996 | Noriega et al. | 224/901.8 X |
| 5,511,703 | 4/1996 | Ryerson | 224/664 |
| 5,562,238 | 10/1996 | White | 224/914 |

*Primary Examiner*—Allan N. Shoap
*Assistant Examiner*—Gregory M. Vidorich
*Attorney, Agent, or Firm*—Henry S. Jaudon; Cort Flint

[57] ABSTRACT

An article holder for concealed use beneath an outer garment about a wearers torso in a selected position at the waist or chest. The holder comprises an elongated elastic band having loop and hook securing members attached at each end for adjustable attachment thereof about said wearers torso. At least one pistol holster is formed on one side of the band in the vicinity of an end thereof. The pistol holster is positioned diagonally of the band for easy access. A non-elastic strap, which is connectable with the holster, is provided for securing a weapon therein. A plurality of multi-compartment pockets are formed with the band. The compartments are selectively sized to receive ammunition magazines, pocket knives, keys, money cartridges, identification, etc.

18 Claims, 3 Drawing Sheets

ARTICLE CARRIER

BACKGROUND OF THE INVENTION

The invention relates to a multi-article holder which is designed to be secured about a wearer's torso in the area of the chest beneath the arms or in the area of the waist. The article holder is designed for use beneath outer garments in a concealed condition. A primary use of the article holder is as a holster for a concealed weapon.

Article carriers and especially weapon holders are well known. Normally, these known devices are limited to a carrier for a single weapon and do not contemplate the provision of additional compartments for ammunition, identification, keys, knives, etc. See for example U.S. Pat. Nos. 4,029,242; 4,966,320; 5,054,671; and 4,579,265.

Also known is the use of elastic belts, connectable with hook and loop connectors, for use as concealed article holders. These belts do not envision the inclusion of weapon holsters. See U.S. Pat. Nos. 4,341,331 and 4,440,525.

The present invention has for its object an article carrier designed with a multiple of compartments for selective use about the chest area beneath the arms or about the waist and beneath an outer garment.

Another object of the invention is an elastic article holder of adjustable length.

Another object of the invention is an article holder constructed with a plurality of compartments designed to accommodate a variety of different items.

Another object of the invention is an article holder provided with non-chafing pads.

Another object of the invention is an article holder which includes an over the shoulder support strap.

Another object of the invention is an article holder which includes an adjustable mounting for its holster compartments.

Another object of the invention is the provision of a economical, reliable, concealable article holder.

SUMMARY OF THE INVENTION

The instant invention is directed to an article holder for use in a selected position about a person's waist or chest.

The holder comprises a band of elastic material which is about 5" wide and includes an attachment device at each end thereof. A plurality of compartments of varying sizes are secured at selected angles along one side of the band. The compartments are also formed of elastic material.

First ones of the compartments comprise left and right pistol holsters which are secured with the band at opposed angles of less and more than 90° with the longitudinal axis of said band. There is provided a releasable strap with each holster for securing a weapon or other article therein. Another of the compartments comprises a pocket secured centrally of the band, between the holsters and at 90° of the longitudinal axis. The pocket includes a plurality of varying size pouches capable of carrying identification, keys, paper, etc.

The holder is designed to carry at least two pistols and two magazines pouches in a concealed manner beneath an outer garment of the wearer with the pistols being held at selected angles for easy access.

There are provided other compartments which include a plurality of sections of cartridge loops which are located between the holsters. Also, at least one of the compartments is sized to receive a pocket knife.

An attachment member is secured adjacent an upper edge of the compartment side of the band adjacent each of the holsters. A strap, which may be about 1" wide, formed of non-elastic material and provided with attachment members at each end, is provided for connecting with the attachment members to form an over the shoulder support for the article holder. There may be two straps, one associated with each holster or a single strap may connect with an outer side adjacent of each holster for an across the shoulder support.

It is preferred that the attachment members are hook and loop type attachment members although snaps, buckles or other known types may be employed.

At least one of the holsters may be adjustably secured with the band so that its position angle may be varied between limits. Preferably the adjustable holster includes a case which is secured at its upper end with the band by a pivotal connection. There is a hook and loop connection with the band at its opposite end for selective positioning of the case about the pivot.

An absorbent pad may be secured with the side of the band opposite at least one of the holsters. The pad is provided as a cushion to prevent chafing.

The pad is usually formed of a 3/16" thick foam material.

The preferred non-elastic material for the band and strap is nylon yarn.

An article holder for concealed use beneath an outer garment in a selected position about a wearer's waist or chest is provided. The holder includes an elongated elastic band having loop and hook securing members attached at each end for adjustable attachment thereof about the wearers torso. A pistol holster is attached to one side of the band in the vicinity of each end thereof. The pistol holsters are positioned diagonally of the band for easy access. Non-elastic straps which connect with the band and holsters are provided for securing pistols therein.

Multi-compartment pockets are secured with the band between the pistol holsters. Selected of the compartments are sized to receive ammunition magazines and pocket knives while other of the compartments are sized to receive identification, money, keys, handcuffs, mace, paper, etc.

In use the article holder is placed about a selected area of the wearer's torso in stretched condition, secured as a loop beneath the outer garment in a concealed condition.

DESCRIPTION OF A PREFERRED EMBODIMENT

Figure 1:
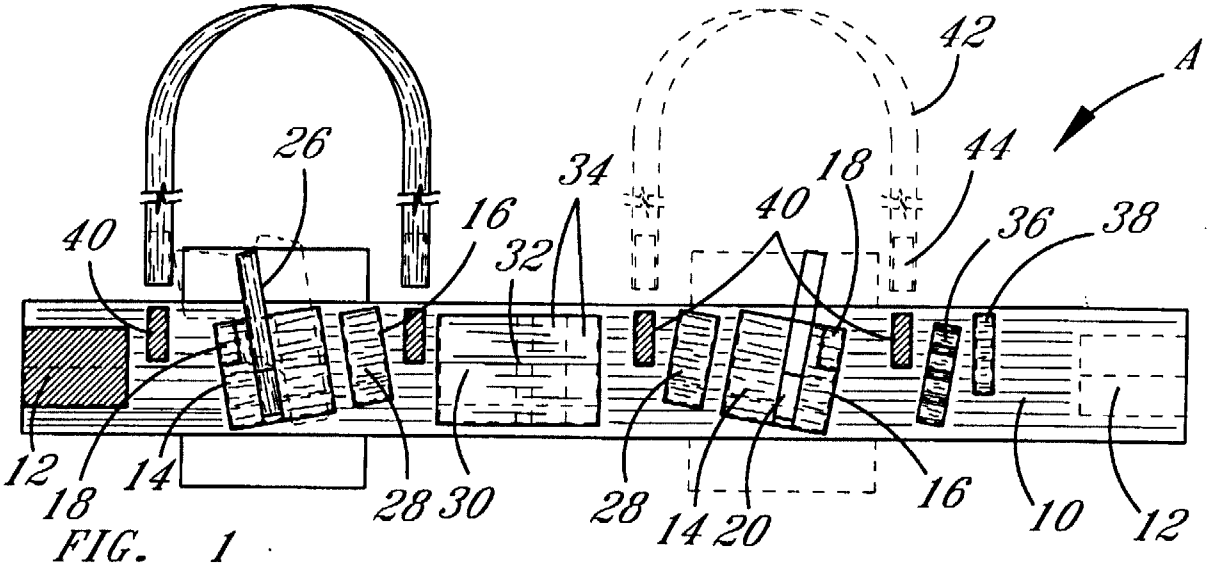
FIG. 1 is a side view of a first embodiment of the article holder arrangement of the invention.
Figure 2:
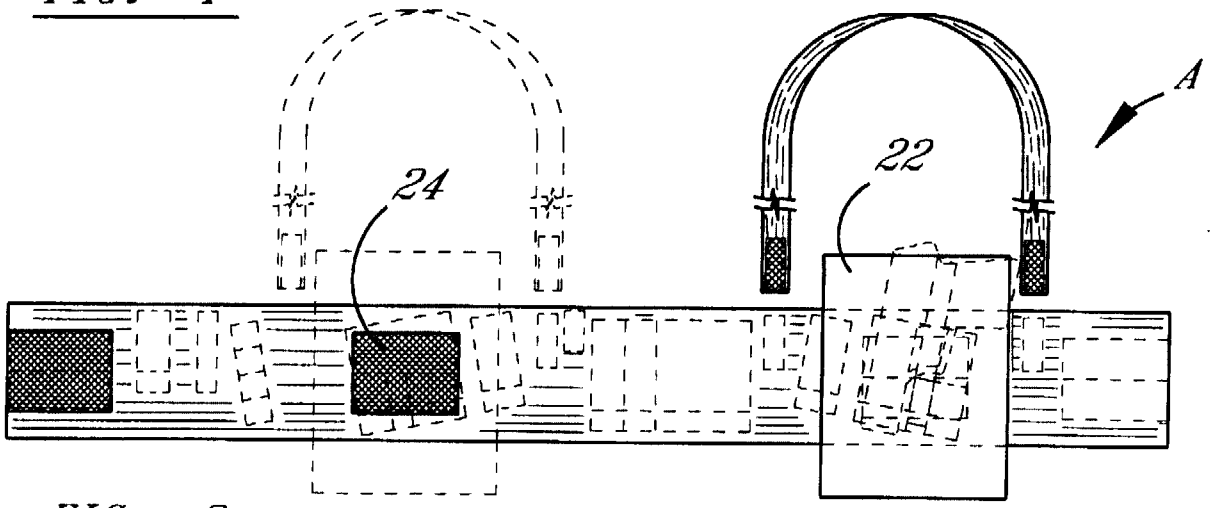
FIG. 2 is a side view showing the inside of the article holder arrangement of FIG. 1.

Turning now to the drawings, FIGS. 1 and 2 show in detail a first embodiment of the article holder of the invention. Article holder A is formed of an elongated elastic web 10 which is preferably woven of elastic and nylon yarns to be about 5" wide and of selected varying lengths. At each end of web 10 and on opposite sides are attached 4" swatches of hook and loop attaching members 12, i.e. VELCRO. Attaching members 12 allow the band to be placed about a wearer's torso, either under the arms or about the waist and secured in position. It is noted that band 10 could be formed by knitting or other suitable fabricating methods.

At a selected distance from each end of band 10 are formed a pair of holsters 14 which are designed to receive and support a pistol. In embodiment A, each holster is formed of a 4"×4" swatch, preferably but not necessarily of the same material forming band 10, secured with the outer face of the band by stitching 16. The upper end of holster 14 is positioned at about a 10° angle away from vertical and toward the associated end of band 10. There is a 1" square 18 sewn into the lower outer corner which engages with the trigger housing of an inserted pistol to position it in the holster. A 1" swatch of hook and loop material forming connector 20 is also sewn to the lower outer corner of holster 14.

On the back side of band 10, opposite holsters 14, a 4"×4" swatch of hook and loop material forming connector 24 is attached by sewing. A 1"×5" strap 26 having hook and loop attaching swatches at each end is designed to engage with connector 24, pass over a housed pistol and to secure with connector 20. Strap 26 operates to secure the pistol in holster 14.

A pad 22 of foam material formed to be approximately 7"×7" is provided to act as a cushion between band 10 and the body to prevent chafing. The material forming pad 22 is soft, resilient and capable of being held by hook and loop connector 24.

Adjacent each holster 14 and toward the center of band 10 are formed magazine carriers 28. Each carrier 28 is positioned to extend parallel with the inner edge of the associated holster 14. Magazine carriers 28 are sized to receive and carry spare ammunition magazines for the pistol or pistols carried by holsters 14. Both holsters 14 and magazine carriers 28 are angled for easy access.

At approximately the center of band 10, a 7"×4" swatch 16 is secured by stitching to form a plurality of pockets or compartments. A first of the pockets 30 is formed to be about 2" wide and 4" deep. Pocket 30 is designed to carry money, credit cards, identification or handcuffs. Adjacent pocket 30 is pocket 32 which is formed to be about 1"×2". Pocket 32 is designed to carry keys, a pen light, or a knife. Adjacent pocket 32 there are a pair of 2"×2" pockets or compartments 34 formed side by side. Pockets 34 are designed to carry pagers, extra ammunition, magazines, pepper spray, etc.

If desired one or more swatches may be stitched to band 10 in the for of ammunition loops 36. Ammunition loops 36 are also located to extend parallel with an associated holster 14.

Adjacent an end of band 10 is formed a 3"×1" pocket 38 which may be used to carry a pen, knife, or keys.

Obviously, while pockets 30, 32, 34, and 38 are designed for specific items they, as well as holsters 14, are equally functional for carrying other selected items as determined by the user.

Figure 5:
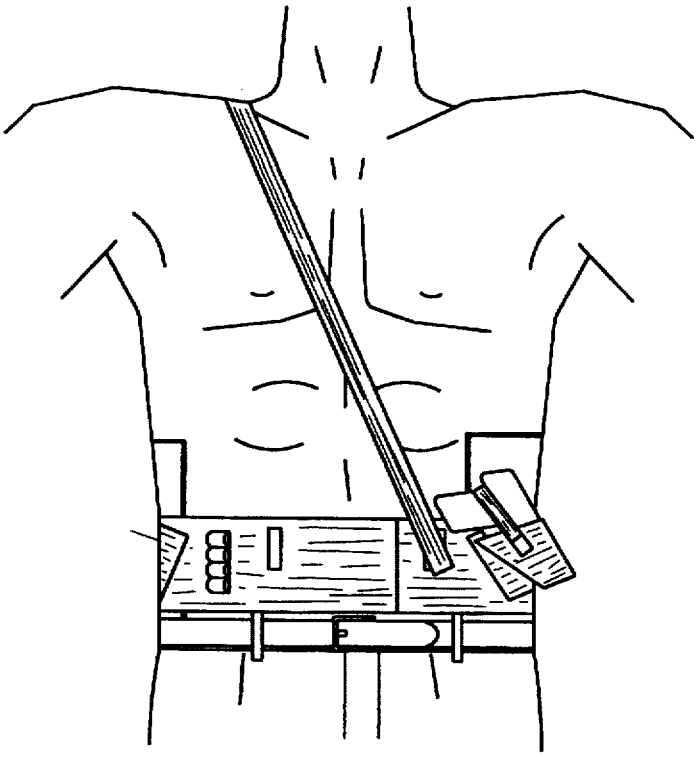
FIG. 5 is a diagramatic view of the article holder arrangement in position about the waist.
Figure 6:
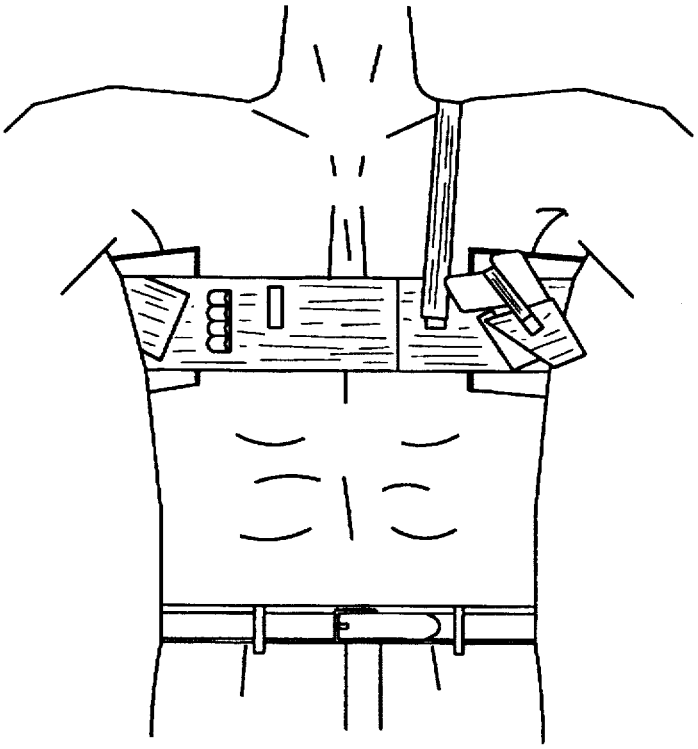
FIG. 6 is a diagramatic view of the article holder in position about the upper torso.

Adjacent the upper edge of band 10 are secured four 1"×2" swatches of hook and loop material forming connectors 40. These connectors 40 are designed to engage with connectors 44 also of hook and loop swatches secured at opposite ends of straps 42. Straps 42 act to fit over the shoulder of the wearer to additionally support band 10 in a fixed position about the torso. It is noted that straps 42 may vary between about 20" for use with band 10 when under the wearer's arms as shown in FIG. 6 and about 36" for use with band 10 when positioned about the waist as shown in FIG. 5.

Figure 3:
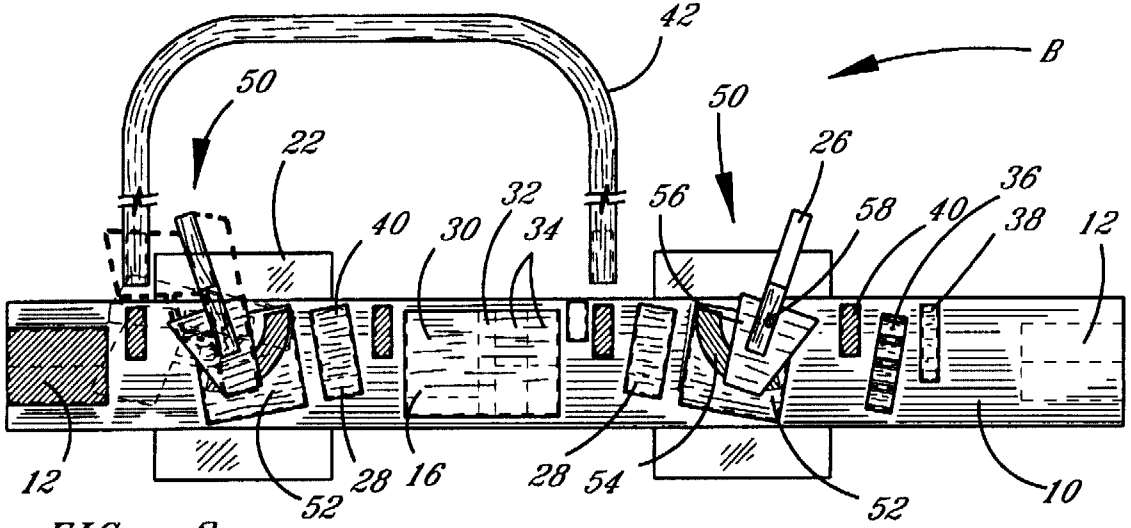
FIG. 3 is a side view of a second embodiment of the article holder of the invention.
Figure 4:
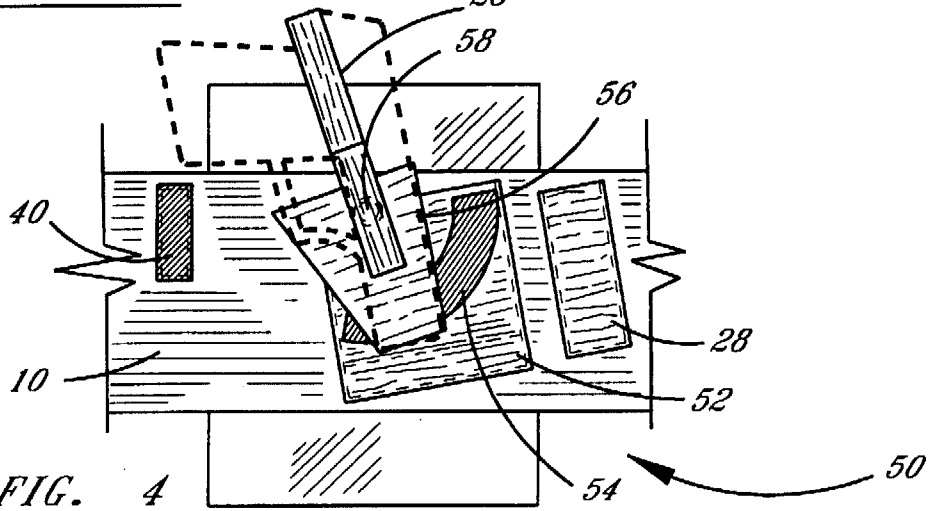
FIG. 4 is an enlarged section of the adjustable article holder of FIG. 3.

Turning now to FIGS. 3 and 4, a second embodiment B of the invention is shown. The article carrier B is substantially identical with article carrier A in all aspects except for the construction of an adjustable holster arrangement 50. Consequently, pockets, straps, and engage connectors 12, 24, 26, 28, 30, 32, 34, 36, 38, 40, and 42 will not be described as associated with article carrier B.

Holster 50 is constructed by stitching swatches 52 with band 10 as shown. It is noted that the pair of swatches 52 are located in substantially the same positions as the swatches forming holster 14 of article carrier A. An arcuate strip of hook and loop material forming a position locating connector 54 is secured with swatch 52. A pivot 58, in the form of a snap or a brad, is secured adjacent the upper outer corner of the swatch.

Case 56 is formed of inelastic material which is substantially in the shape of a cone. Pivot 58 is secured with case 56 providing a pivotal connection of case 56 with swatch 52. The lower inner side of case 56 is provided with a connector of hook and loop material which engages with connector 54 to stationarily secure case 56 at a desired angle or in a selected position.

In practice holster 50 may be adjusted to position case 56 carrying a pistol in a most desirable position selected between a plurality of positions. As earlier stated, straps 26 act to retain the pistol in position in the manner earlier described.

It is noted that the article holder may comprise a combination of arrangements A and B. That is a holster 14 may be formed adjacent one end of band 10 while a holster 50 may be formed adjacent the opposite end.

While two holsters are shown it is not necessary that two pistols be carried simultaneously. A single pistol in a selected holster may be desirable.

It is noted that while hook and loop connectors are preferred, other conventional connectors such as snaps, buttons, and buckles may be employed with the carrier structure of the invention.

The article holder of the invention is designed to be worn beneath outer clothing in a concealed manner. The article carrier may be worn under a shirt, a coat, or a jacket.

The device is intended to carry a concealed weapon or weapon and accessories. Surprise rather than easy access and a fast draw is its function. As a consequence, normally a cross draw is utilized to expose the pistol.

What is claimed is:

1. An article holder for concealed use in a selected position about a person's waist and chest comprising:

a band of elastic material of a selected length having an attachment device at each end thereof;

a plurality of compartments of varying sizes, formed of said elastic material and positioned at selected angles along one side of said band;

first ones of said compartments comprise left and right pistol holsters, said holsters being respectively positioned with said band at opposed angles of less and more than 90° with the longitudinal axis of said band;

second ones of said compartments comprise a magazine pockets respectively positioned between and adjacent a first side of each of said holsters, each said magazine pocket being aligned with said adjacent one of said holsters;

said pistol holsters and said magazine pockets being respectively selected to accommodate removal of pistols and magazines from said article holder while concealed beneath an outer garment of the person; and, a first pair of hook and loop patches respectively affixed to said one side of said band adjacent opposing sides of said left holster and a second pair of hook and loop patches respectively affixed to said one side of said band adjacent opposing sides of said right holster, each said pair of hook and loop patches for releasable securement with a respective support strap.

2. The article holder of claim 1 wherein certain other of said compartments comprise a plurality of sections of cartridge loops, said cartridge loops being located between said holsters.

3. The article holder of claim 1 wherein at least one of said compartments is sized to receive a pocket knife.

4. The article holder of claim 1 including a multi-section pocket positioned between said holsters intermediate ends of said band, compartments of said multi-section pocket being variably sized to receive identification, money, keys, pager, and other similar sized articles.

5. The article holder of claim 1 including non-elastic straps having hook and loop attachment members at each end thereof for respectively attaching with one of said pair of hook and loop patches for forming over the shoulder support straps.

6. The article holder of claim 5 wherein said shoulder straps are each is about 1" wide.

7. The article holder of claim 1 wherein said attachment device comprises hook and loop attachment members.

8. The article holder of claim 1 including a removable strap associated with each said holster for securing a pistol therein.

9. The article holder of claim 1 including an absorbent pad removably attached on a second side of said band opposite at least one of said holsters, said pad being operative to prevent chafing.

10. The article holder of claim 9 wherein said pad is comprised of a 3/16" thick foam material.

11. The article holder of claim 1 wherein said band is about 5" wide.

12. The article holder of claim 1 wherein said band includes nylon yarn.

13. An article holder for concealed use beneath an outer garment about a wearer's torso in a selected waist and chest position comprising:

an elongated elastic band having loop and hook connectors attached at each end for adjustable attachment thereof about said wearer's torso;

a pistol holster attached to an outer side of inner and outer sides of said band in the vicinity of an end thereof, said pistol holster being positioned diagonally of said band for easy access;

a first hook and loop patch, secured with said inner side of said band opposite said holster;

a second hook and loop patch, secured with an outer side of said holster opposite said first hook and loop patch;

a non-elastic strap removably connected with said first and second hook and loop patches for securing a pistol in said holster;

multi-compartment pockets secured with said one side of said band, selected of said compartments being sized to receive ammunition magazines and pocket knives while other of said compartments are sized to receive identification, money and keys; whereby, said article holder for placement about a wearer's torso in a stretched condition and secured as a loop by said connectors beneath said outer garment in a concealed condition.

14. The article holder of claim 13 including a foam pad secured with said first hook and loop patch opposite said pistol holster.

15. The article holder of claim 13 including an inelastic strap releasably secured at each end with an upper edge of said band for additional support.

16. The article holder of claim 13 wherein said pistol holster is pivotally attached to said outer side of said band.

17. The article holder of claim 16 wherein said pistol holster includes a patch of hook and loop material on a rear side thereof and said band includes a patch of hook and loop material on said outer side of said band adjacent said rear side of said pistol holster, said patch of hook and loop material on said rear side of said holster and said patch of hook and loop material on said outer side of said band adjacent said rear side of said pistol holster engage to stationarily secure said pistol holster at a desired angle.

18. An article holder for concealed use beneath an outer garment about a wearer's torso in a selected waist and chest position comprising;

an elongated elastic band having loop and hook connectors attached at each end for adjustable attachment thereof about said wearer's torso;

a pistol holster attached to an outer side of inner and outer sides of said band in the vicinity of each end thereof, said pistol holsters being positioned diagonally of said band for easy access;

a first pair of hook and loop patches having a first patch of said first pair secured with said inner side of said band opposite one of said pistol holsters and a second patch of said first pair secured with an outer side of said one pistol holster;

a second pair of hook and loop patches having a first patch of said second pair secured with said inner side of said band opposite the other of said pistol holsters and a second patch of said second pair secured with an outer side of said other pistol holster;

a pair of non-elastic straps, each of said non-elastic straps removably connectable with one of said pairs of hook and loop patches for respectively securing a pistol in its associated pistol holster;

multi-compartment pockets secured with said outer side of said band, selected of said compartments being sized to receive ammunition magazines and pocket knives while other of said compartments are sized to receive identification, money and keys; and, a foam pad removably secured with one of said hook and loop patches on said inner side of said band; whereby, said article holder for placement about a wearer's torso in a stretched condition and secured as a loop by said connectors beneath said outer garment in a concealed condition.

* * * * *